US010168003B2

(12) United States Patent
Sundqvist et al.

(10) Patent No.: US 10,168,003 B2
(45) Date of Patent: Jan. 1, 2019

(54) VALVE SYSTEM FOR AN LNG TANK

(71) Applicant: WARTSILA FINLAND OY, Vaasa (FI)

(72) Inventors: Henrik Sundqvist, Vaasa (FI); Mathias Jansson, Vaasa (FI); Soren Karlsson, Vaasa (FI)

(73) Assignee: WARTSILA FINLAND OY, Vaasa (FI)

( * ) Notice: Subject to any disclaimer, the term of this patent is extended or adjusted under 35 U.S.C. 154(b) by 0 days.

(21) Appl. No.: 15/548,013

(22) PCT Filed: Feb. 24, 2015

(86) PCT No.: PCT/FI2015/050106
§ 371 (c)(1),
(2) Date: Aug. 1, 2017

(87) PCT Pub. No.: WO2016/135372
PCT Pub. Date: Sep. 1, 2016

(65) Prior Publication Data

US 2018/0023766 A1 Jan. 25, 2018

(51) Int. Cl.
*F17C 13/04* (2006.01)
*F17C 13/12* (2006.01)

(52) U.S. Cl.
CPC ..... *F17C 13/04* (2013.01); *F17C 13/12* (2013.01); *F17C 2201/0114* (2013.01); *F17C 2201/035* (2013.01); *F17C 2201/052* (2013.01); *F17C 2203/03* (2013.01); *F17C 2205/0332* (2013.01); *F17C 2205/0355* (2013.01); *F17C 2205/0397* (2013.01); *F17C 2221/033* (2013.01); *F17C 2223/0161* (2013.01);
(Continued)

(58) Field of Classification Search
CPC .. F17C 13/04; F17C 13/12; F17C 2201/0114; F17C 2201/035; F17C 2205/0332; F17C 2205/0355; F17C 2221/033; F17C 2223/0161; F17C 2260/042; F17C 2270/0105
USPC ..... 137/625.12, 625.28, 637.1, 599.08, 137/599.01, 872
See application file for complete search history.

(56) References Cited

U.S. PATENT DOCUMENTS 2,677,939 A * 5/1954 Clute ..... F17C 1/00 137/202
2,721,529 A 10/1955 Jahnsen
(Continued)

FOREIGN PATENT DOCUMENTS

AT 11211 U1 6/2010
CN 202118517 U 1/2012
(Continued)

*Primary Examiner* — Jessica Cahill
(74) *Attorney, Agent, or Firm* — Muncy, Geissler, Olds & Lowe, P.C.

(57) ABSTRACT

The invention relates to a valve system of a fuel tank, especially of an LNG tank, which valve system includes at least two pressure relief safety valves, in which valve system one pressure relief safety valve is located in one safety valve branch branching from an outlet line from the LNG tank. The valve system further comprises interconnected shutoff valves for shutting off one of the safety valve branches at time and that the shutoff valves are diverter valves with a T-bore.

6 Claims, 4 Drawing Sheets

(52) U.S. Cl.
CPC .. *F17C 2223/033* (2013.01); *F17C 2260/042* (2013.01); *F17C 2270/0105* (2013.01)

(56) References Cited

U.S. PATENT DOCUMENTS

| | | | | |
|---|---|---|---|---|
| 7,546,744 | B2 * | 6/2009 | Harper | F17C 1/12 141/4 |
| 2009/0320781 | A1 | 12/2009 | Kwon | |
| 2011/0297273 | A1 * | 12/2011 | Kempen | F17C 6/00 141/5 |
| 2014/0075965 | A1 * | 3/2014 | Patelczyk | F17C 7/04 62/50.3 |
| 2014/0223924 | A1 * | 8/2014 | Gustafson | F02M 21/0212 62/45.1 |
| 2016/0245459 | A1 * | 8/2016 | Grimmer | F17C 5/06 |
| 2017/0343161 | A1 * | 11/2017 | Byggmastar | F17C 13/04 |

FOREIGN PATENT DOCUMENTS

| | | | |
|---|---|---|---|
| DE | 10 2006 025 654 | A1 | 12/2007 |
| EP | 2 765 296 | A1 | 8/2014 |

* cited by examiner

VALVE SYSTEM FOR AN LNG TANK

BACKGROUND OF THE INVENTION

Field of the Invention

The invention is in general related to the field of using liquid fuel, in particular liquefied natural gas (LNG), as a marine fuel in one or more engines of a marine vessel or of a corresponding sea-going ship. In particular the invention is related to a valve system of an LNG tank. More particularly the invention relates to the valve system of an LNG tank according to the preamble of independent valve system claim.

In publication CN 2021185170 is disclosed a blowing-down anti-explosion system with double safety valves, which being mainly composed of a tee joint stop valve, a left safety valve and a right safety valve, wherein the left safety valve and the right safety valve are respectively arranged on the tee joint stop valve.

Brief Description of the Related Art

Liquid fuels that are used as marine fuels are typically liquefied natural gas, liquefied petroleum gas or liquid petroleum gas (LPG), methanol, ethylene. Natural gas is in gaseous form in room temperature. In marine vessels that use natural gas as fuel, the natural gas is typically stored onboard in liquid form, and thus this marine fuel is commonly called by its acronym LNG (Liquefied Natural Gas). Natural gas can be kept in liquid form by maintaining its temperature below a boiling point, which is approximately −163° C. LNG system onboard comprises typically a bunkering station, which is the marine vessel's connection with a LNG terminal on shore or with an LNG bunkering barge, insulated pipes for leading LNG to an LNG tank, which is for storage of LNG and a tank room where LNG is controllably evaporated and its distribution to the engine(s) is arranged. The bunkering station comprises typically one bunkering line (LNG line), one return line and one nitrogen purging line with respective control and safety valves and flanges. The return line is needed when the bunkering operation is performed with two connected hoses for returning the possibly evaporated gas to the bunkering terminal or the bunkering barge. The natural gas is delivered to the engines as a gas but stored as a liquid. A tank room or a tank connection space is associated with a storage tank and contains the equipment to convert the liquid into a gas for safe delivery to the engines. The tank room is also considered a 'secondary barrier' in case there should be leakage of the LNG, since liquid pipes and valves are inside it.

For LNG fuelled vessels it is required by international regulations to have at least two pressure relief safety valves and a safety valve branch for each pressure relief safety valve for LNG tank, which two pressure relief safety valves need to be fitted with shutoff valves before and after each of the pressure relief safety valves in each of the safety valve branches, for maintenance purposes of the pressure relief safety valves. Thus the shutoff valves need to be interlocked, in a way that it is possible to close only one pressure relief safety valve and its safety valve branch at a time so that at least one pressure relief safety valve is in operation at all times.

In FIG. 1 is shown schematically a simplified example of a valve system of an LNG tank according to prior art, in which an outlet line 21 from the LNG tank 10 is divided into two safety valve branches 23, 24 each comprising a pressure relief safety valve 12, 15 with shutoff valves 7, 9 before and shutoff valves 13, 14 after each of the pressure relief safety valves 12, 15. After the after the pressure relief safety valves

12, 15 located shutoff valves 13, 14 the safety valve branches connect to a common outlet line 22 for ventilation out to ventilation mast. The pressure relief safety valves 12, 15 will open for safety reasons when the pressure of the LNG tank exceeds the set safety limit. In this prior art system the shutoff valves 7, 9; 13, 14 are globe valves and interlocked with key and lock system with free keys FA, FB, FD and trapped keys TB, TC, TD, TE. The keys are mechanical keys for mechanical locks. For shutting off the pressure relief safety valve 12 in the safety valve branch 23 first free key FA is used to release the shutoff valve 7 to be closed and to release trapped key TB to be used for releasing the shutoff valve 13 to be closed and to release trapped key TC, which cannot be used for the other safety valve branch 24. As free key FA is in use the other safety valve branch cannot be closed. When the pressure relief safety valve 12 is ready to be used again the safety valve branch 23 is opened again in using the keys in reverse order. After this the free key FA is released and ready for use for example for closing the other safety valve branch 24 correspondingly. As can be readily understood, the key interlocking system is quite complicated.

SUMMARY OF THE INVENTION

An object of the present invention is to provide an improved a valve system of a fuel tank, in particular of an LNG tank, in which the problems described above are eliminated or at least minimized.

One particular object of the invention is to create a valve system of a fuel tank, in particular of an LNG tank, which is simple and cost effective.

Another particular object of the invention is to create a valve system of a fuel tank, in particular of an LNG tank, which is easy to optimize in view of location and required space as well as in view of the fuel system construction.

In order to achieve the above objects and those that will come apparent later the bunkering station according to the invention is characterized by the features of the characterizing part of independent valve system claim. Advantageous embodiments and features are defined in dependent claims.

According to the invention the valve system of a fuel tank, especially of an LNG tank comprises at least two pressure relief safety valves, in which valve system one pressure relief safety valve is located in one safety valve branch branching from an outlet line from the LNG tank and the valve system further comprises interlocked shutoff valves for shutting off one of the safety valve branches at time and that the shutoff valves are diverter valves with a T-bore.

According to an advantageous embodiment of the invention the shutoff valves are interlocked by a mechanical connector.

According to another embodiment the interconnected shutoff valves are interlocked with a mechanical key and lock system with free keys and trapped keys, especially in in cases where location and required space as well as in view of the fuel system construction.

According to an advantageous feature of the invention the safety valve branches branch from an outlet line from the LNG tank and connect to a common outlet line to a ventilation mast of the marine vessel and one of the shutoff valves is located at the branching point of the outlet line from the LNG tank and one of the shutoff valves is located at the connecting point to the common outlet line.

According to an advantageous feature of the invention the shutoff valves for the pressure relief safety valves of the LNG tank are diverter valves with T-bore and the shutoff valves are interlocked mechanically such that when one shutoff valve is turned to another position, for example to close one safety valve branch and keep the other valve branch open, the other valve will turn at the same time to corresponding position, i.e. closing the same safety valve branch and keeping the other branch open. Thus only two shutoff valves are needed and the interlocking is much simpler.

According to an advantageous feature in the embodiment, in which the shutoff valves are interlocked by the mechanical connector, as mechanical connector a chain or by a bar or by a pinion is used. According to an advantageous feature the valve system is located in a tank connection space of a marine vessel.

By the invention several advantages are achieved firstly the number of shutoff valves needed in the valve system of the LNG tank is reduced by half and secondly the interlocking of the shutoff valves will be much simpler. Furthermore less pipes and welding is needed and thus also the assembly work is reduced.

BRIEF DESCRIPTION OF THE DRAWINGS

In the following the invention is described in more detail by reference to the accompanying drawing in which.

DETAILED DESCRIPTION OF THE PREFERRED EMBODIMENTS

Figure 1:
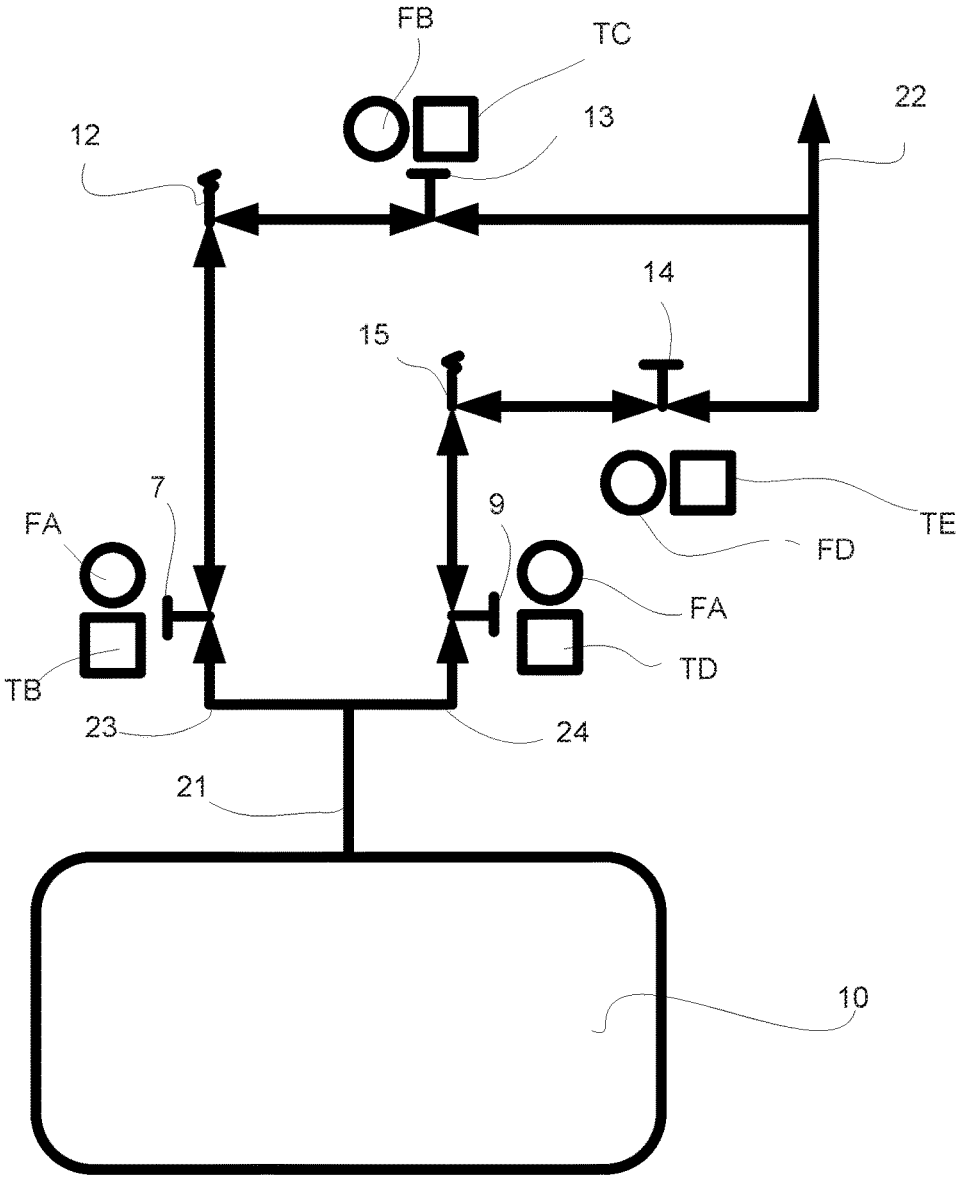
Fig. 1 prior art
FIG. 1 shows schematically a simplified example of a valve system of an LNG tank according to prior art and FIGS. 2A-2D show schematically a simplified example of a valve system of an LNG tank according to an advantageous example of the invention.
Figure 2A:
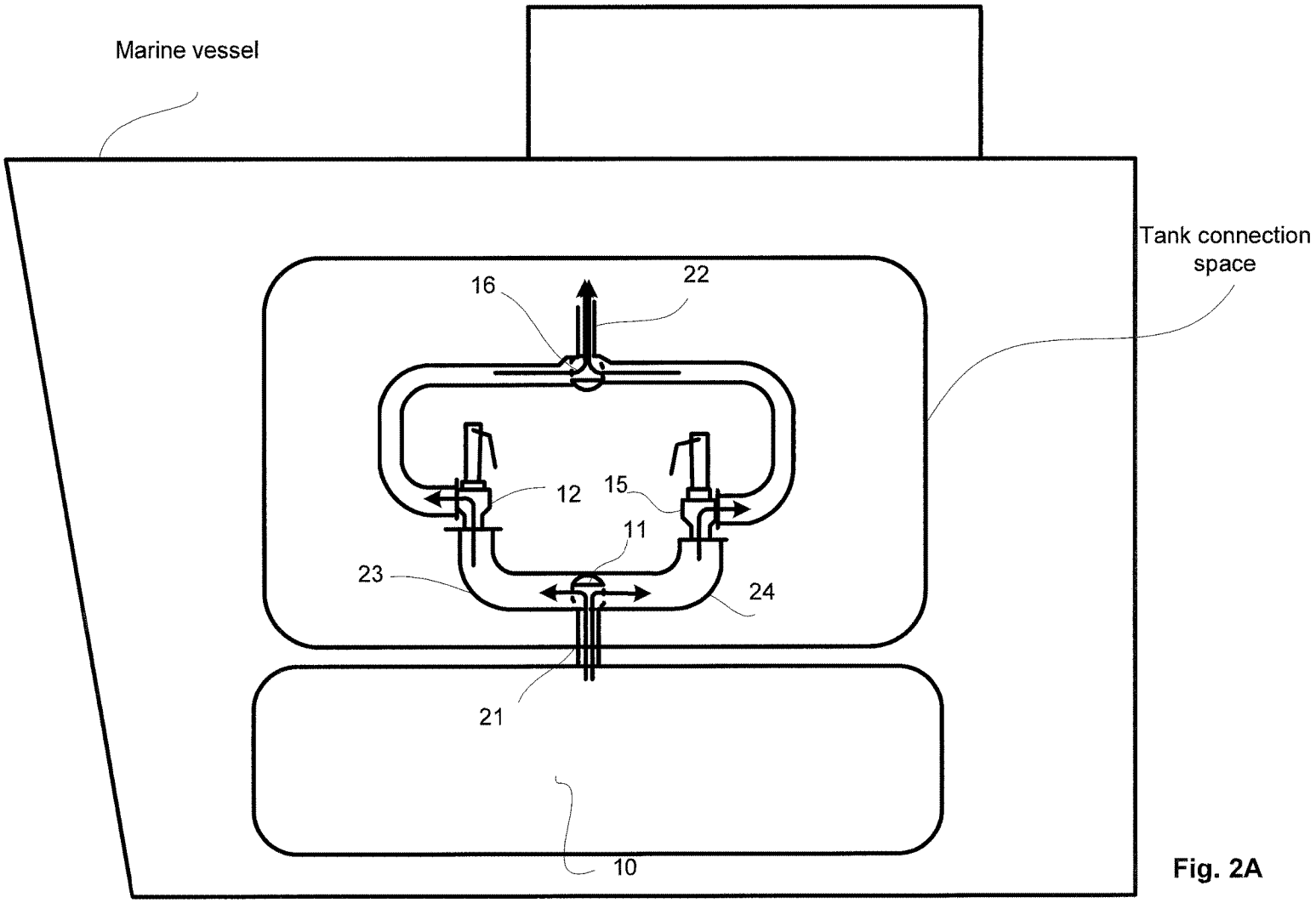
Figure 2C:
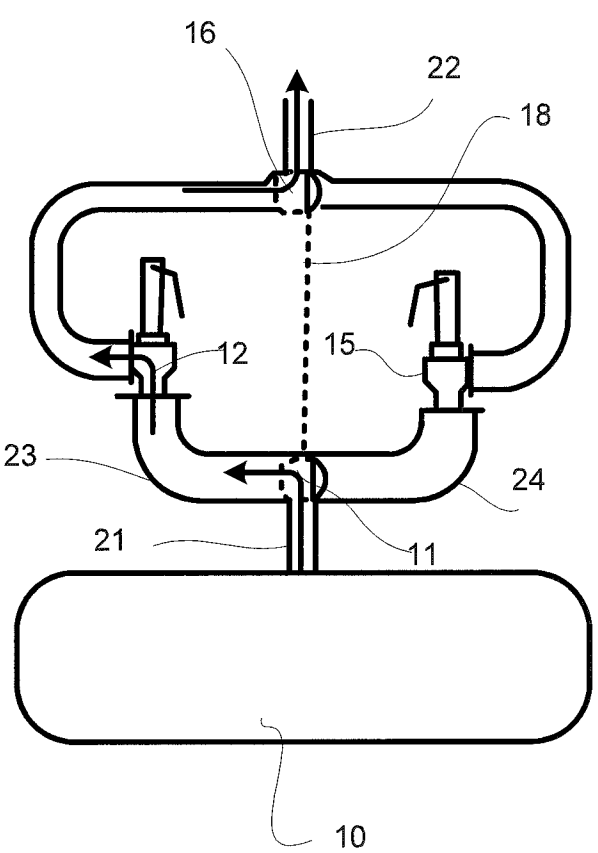

During the course of the following description of FIGS. 1-2C corresponding reference numbers and signs will be used to identify like elements, parts and part components unless otherwise mentioned. In the figures some references sign have not been repeated for clarity reasons. In the following the examples are described mainly by reference to an LNG tank of a marine vessel in view of simplifying the disclosure but it should be noted that instead of this example any type of a valve system of an LNG tank or a LPG tank or ethane tank can have similar features and properties in accordance with the invention.

In FIG. 1 is shown a simplified example of a valve system of an LNG tank according to prior art, in which an outlet line 21 from the LNG tank 10 is divided into two safety valve branches 23, 24 each comprising a pressure relief safety valve 12, 15 with shutoff valves 7, 9 before and shutoff valves 13, 14 after each of the pressure relief safety valves 12, 15. After the after the pressure relief safety valves 12, 15 located shutoff valves 13, 14 the safety valve branches connect to a common outlet line 22 for ventilation out to the ventilation mast. The pressure relief safety valves 12, 15 will open for safety reasons when the pressure of the LNG tank exceeds the set safety limit. In this prior art system the shutoff valves 7, 9; 13, 14 are globe valves and interlocked with key and lock system with free keys FA, FB, FD and trapped keys TB, TC, TD, TE. The keys are mechanical keys for mechanical locks. For shutting off the pressure relief safety valve 12 in the safety valve branch 23 first free key FA is used to release the shutoff valve 7 to be closed and to release trapped key TB to be used for releasing the shutoff valve 13 to be closed and to release trapped key TC, which cannot be used for the other safety valve branch 24. As free key FA is in use the other safety valve branch cannot be closed. When the pressure relief safety valve 12 is ready to be used again the safety valve branch 23 is opened again in using the keys in reverse order. After this the free key FA is released and ready for use for example for closing the other safety valve branch 24 correspondingly.

Figure 2B:
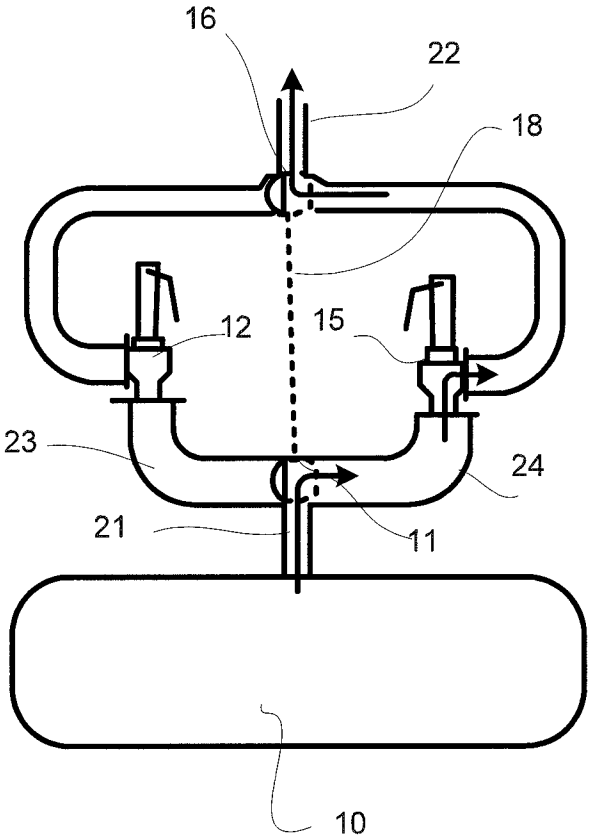
Figure 2D:
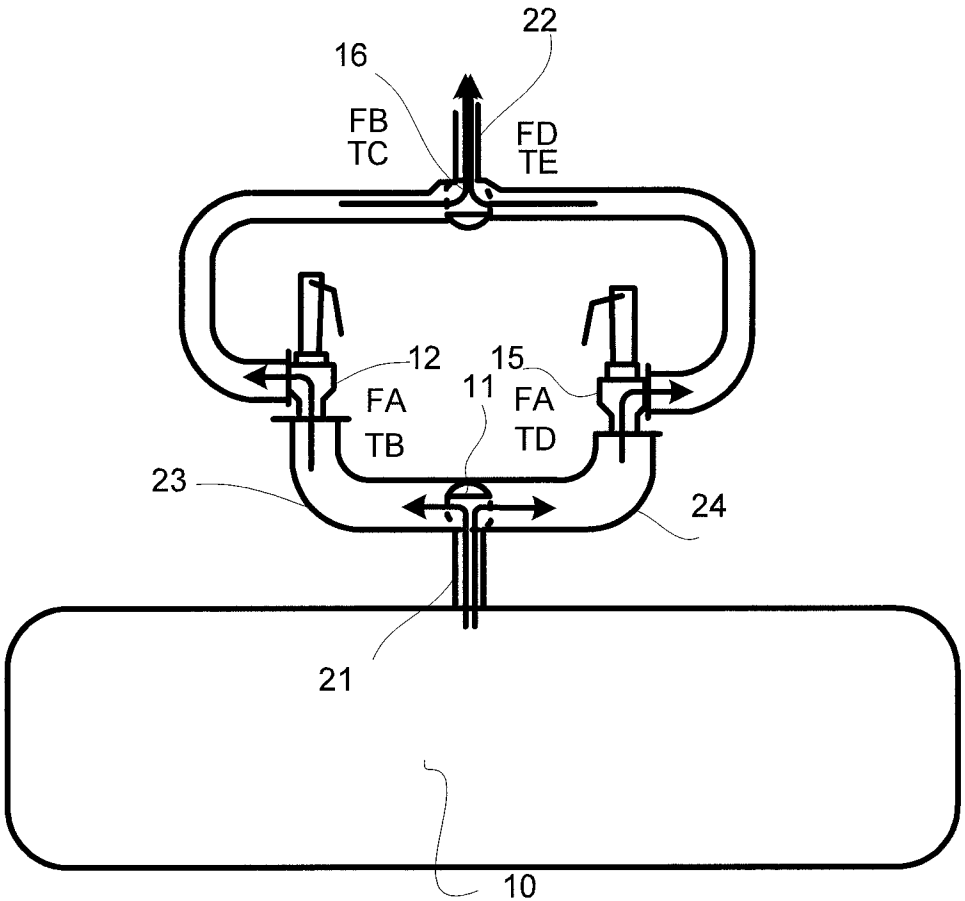

FIGS. 2A-2D show schematically a simplified example of a valve system of an LNG tank, which valve system is located advantageously in a tank connection space of a marine vessel, according to an advantageous example of the invention. In FIG. 2A the valve system is as used in normal conditions and in FIG. 2B, when one of the pressure relief safety valves is under maintenance; in this figure the pressure relief safety valve in the left hand side safety valve branch. In FIG. 2C, when the other of the pressure relief safety valves is under maintenance: in this figure the safety valve of the right hand side safety valve branch. In FIG. 2D, the valve system controls the gas flow using the interconnected shutoff valves that are interlocked with a mechanical key and lock system with free keys FA, FB, FD and trapped keys TB, TC, TD, TE. In FIGS. 2A-2D gas flows from the LNG tank 10 and through the valve system to the outlet line 22 out via the ventilation mast are shown by arrows. As shown in the FIGS. 2A-2D an outlet line 21 from the LNG tank 10 is divided into two safety valve branches 23, 24 each comprising a pressure relief safety valve 12, 15 and the safety valve branches 23, 24 connect to a common outlet line 22 for ventilation out to deck and to air. The pressure relief safety valves 12, 15 will open for safety reasons when the pressure of the LNG tank exceeds the set safety limit The valve system comprises two shutoff valves 11, 16 that are diverter valves with T-bore i.e. three-way valves. One shutoff valve 11 is located at the branching point where the outlet line from the LNG tank 10 branches to the safety valve branches 23, 24, in which the pressure relief safety valves 12, 15 are located. The other shutoff valve 16 is located at the connecting point where safety valve branches 23, 24 connect to each other to a common outlet line 22 from the valve system. The shutoff valves 11, 16 are in this embodiment mechanically connected by a mechanical connector 18 for example by a chain, a bar or a pinion. Thus the shutoff valves 11, 16 are interlocked mechanically such that when one shutoff valve 11 is turned to another position, for example to close one safety valve branch 23 and keep the other valve branch 24 open, the other valve 16 will turn at the same time to corresponding position, i.e. closing the same safety valve branch 23 and keeping the other safety valve branch 24 open. In FIG. 2A the valve system is as used in normal conditions and the gas can flow through both safety valve branches 23, 24 as the T-bore of the shutoff valves 11, 16 allows the flow to each of the safety valve branches 23, 24 and both pressure relief safety valves 12, 15 are in use. In FIG. 2B one pressure relief safety valve 12 is under maintenance and the safety valve branch 23 is shut off by the shutoff valves 11, 16, which are turned such that the T-bore of the shutoff valves 11, 16 closes the safety valve branch 23 and keeps the other safety valve branch 24 open. In FIG. 2C the other pressure relief safety valve 15 is under maintenance and the safety valve branch 24 is shut off by the shutoff valves 11, 16, which are turned such that the T-bore of the shutoff valves 11, 16 closes the safety valve branch 24 and keeps the other safety valve branch 23 open. The shutoff valves 11, 16 are operated manually or by an actuator (not shown).

In another embodiment instead of the mechanical connector 18 the shut off valves 11, 16 are interlocked with key and lock system with free keys and trapped keys as described in reference to FIG. 1. In this embodiment there are mechanical locks on both left and right sides of both the shutoff valves 11, 16 for preventing or allowing to turn the shutoff valve to left or right. The keys are mechanical keys for the mechanical locks. For shutting off one of the pressure relief safety valves 12; 15 in either of the safety valve branches 23; 24 the keys are used correspondingly as explained in connection with FIG. 1. When the pressure relief safety valve 12; 15 is ready to be used again the safety valve branch 23; 24 is opened again in using the keys in reverse order.

REFERENCE SIGNS USED IN THE DRAWING

7 shutoff valve
9 shutoff valve
10 LNG tank
11 shutoff valve
12 pressure relief safety valve
13 shutoff valve
14 shutoff valve
15 pressure relief safety valve
16 shutoff valve
18 mechanical connector
21 outlet line from the LNG tank
22 outlet line from the valve system
23 safety valve branch
24 safety valve branch
FA, FB, FD free key
TB, TC, TD, TE trapped key

The invention claimed is:

1. A valve system for liquefied natural gas (LNG) fuel tank, which valve system comprises two pressure relief safety valves, in which an outlet line from the LNG fuel tank is divided into two safety valve branches each comprising at least one of said two pressure relief safety valves, wherein the valve system further comprises interconnected shutoff valves for shutting off one of the safety valve branches at a time so that at least one of said two pressure relief safety valves is in operation at all times, that the safety valve branches connect to a common outlet line and one of the shutoff valves is located at a branching point of the outlet line for the LNG fuel tank and one of the shutoff valves is located at a connecting point to the common outlet line; and the shutoff valves are diverter valves with a T-bore.

2. The valve system according to claim 1, wherein the shutoff valves are interconnected by a mechanical connector.

3. The valve system according to claim 1, wherein the interconnected shutoff valves are interlocked with a mechanical key and lock system with free keys and trapped keys.

4. The valve system according to claim 1, wherein the shutoff valves are controlled such that when one of the shutoff valves is turned to an open or closed position, the other one of the shutoff valves is turned to the open or closed position, thereby allowing passage through one of the safety valve branches.

5. The valve system according to claim 1, wherein the valve system is located in a tank connection space of a marine vessel.

6. A marine vessel comprising a valve system according to claim 1.

* * * * *